US010969184B2

(12) United States Patent
McLeroy et al.

(10) Patent No.: US 10,969,184 B2
(45) Date of Patent: Apr. 6, 2021

(54) BOLT ACTION FIREARM RECEIVER ASSEMBLIES

(71) Applicant: Daniel Defense, Inc., Black Creek, GA (US)

(72) Inventors: Daniel McLeroy, Savannah, GA (US); Marvin C. Daniel, Pooler, GA (US); Luke South, Lexington, KY (US)

(73) Assignee: DANIEL DEFENSE, INC., Black Creek, GA (US)

( * ) Notice: Subject to any disclaimer, the term of this patent is extended or adjusted under 35 U.S.C. 154(b) by 0 days.

(21) Appl. No.: 16/733,298

(22) Filed: Jan. 3, 2020

(65) Prior Publication Data

US 2020/0224985 A1 Jul. 16, 2020

Related U.S. Application Data

(60) Provisional application No. 62/790,517, filed on Jan. 10, 2019.

(51) Int. Cl.
*F41A 3/66* (2006.01)
*F41A 3/22* (2006.01)

(52) U.S. Cl.
CPC .. *F41A 3/66* (2013.01); *F41A 3/22* (2013.01)

(58) Field of Classification Search
CPC ..... F41A 3/64; F41A 3/66; F41A 3/22
USPC ..... 42/75.01, 75.03, 17, 18, 16
See application file for complete search history.

(56) References Cited

U.S. PATENT DOCUMENTS

| | | | | |
|---|---|---|---|---|
| 8,307,575 | B1 * | 11/2012 | Battaglia | F41A 3/66 42/75.03 |
| 9,631,885 | B2 * | 4/2017 | Jones | F41A 19/11 |
| 2009/0277067 | A1 * | 11/2009 | Gregg | F41A 3/66 42/69.01 |
| 2010/0307042 | A1 * | 12/2010 | Jarboe | F41A 3/18 42/6 |
| 2011/0232148 | A1 * | 9/2011 | Cain | F41A 17/38 42/6 |
| 2014/0317983 | A1 * | 10/2014 | Bush | F42B 5/32 42/17 |
| 2015/0354911 | A1 * | 12/2015 | Hawkins | F41A 9/82 42/49.01 |
| 2017/0030667 | A1 * | 2/2017 | Eitan | F41A 19/11 |
| 2018/0335266 | A1 * | 11/2018 | Cochran | F41A 17/38 |
| 2020/0064091 | A1 * | 2/2020 | Bush | F41A 33/00 |

* cited by examiner

*Primary Examiner* — Jonathan C Weber
(74) *Attorney, Agent, or Firm* — Eversheds Sutherland (US) LLP

(57) ABSTRACT

A firearm receiver assembly is disclosed herein. The firearm receiver assembly includes a receiver having at least two pillar apertures. The firearm receiver assembly also includes a chassis having a top portion, a bottom portion, and a side portion. The receiver is configured to be set within the top portion. The firearm receiver assembly also includes a bottom metal having a top side, a bottom side, a proximate end, and a distal end. More so, the firearm receiver assembly includes at least two integrated pillars extending from the top side of the bottom metal. The at least two integrated pillars are configured to align with the pillar apertures of the receiver.

10 Claims, 10 Drawing Sheets

BOLT ACTION FIREARM RECEIVER ASSEMBLIES

CROSS-REFERENCE TO RELATED APPLICATIONS

The disclosure claims priority to and the benefit of U.S. provisional patent application No. 62/790,517, filed Jan. 10, 2019, which is hereby incorporated by reference herein in its entirety.

FIELD

The disclosure generally relates to bolt action firearm receiver assemblies, and more specifically to the bottom metal.

BACKGROUND

Bolt action firearms are unique weapons comprising a bolt coupled to an operating handle that is cycled within the firearm's receiver when a user manually advances/retracts and rotates the bolt. Bolt action firearms are a favorite among hunters and precision rifle shooters, because bolt action firearms are known for their accuracy and reliability. In most configurations, bolt action firearms comprise a stock, a barrel, a bolt, a magazine, a trigger, a receiver, bottom metal (also known as a trigger guard), and a forestock. Ambient environmental conditions may cause stock distortion (i.e., expansion and contraction of the stock) which, in turn, may decrease the accuracy of the bolt action firearm. Additionally, after substantial use of the bolt action firearm, the forces associated with the firing may change the spacing between the stock, the bottom metal, and the receiver—resulting in a decrease of the firearm's accuracy.

Bolt action firearms are typically assembled by hand and by multiple assemblers. It is well known that the bolt action firearm components (i.e., stock, bottom metal, chassis, and receiver) are very hard to properly space, fit, and install on a consistent basis via hand assembly with multiple users. As a result, consumers who want properly spaced, fitted, and assembled bolt action firearms typically utilize expensive gunsmiths to ensure a proper and correct alignment and adjustment post purchase.

Accordingly, there remains a need for improving the fit and installation of bolt action firearm components that are configured to maintain firearm accuracy with substantial use and that can withstand various ambient environmental conditions.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which the use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
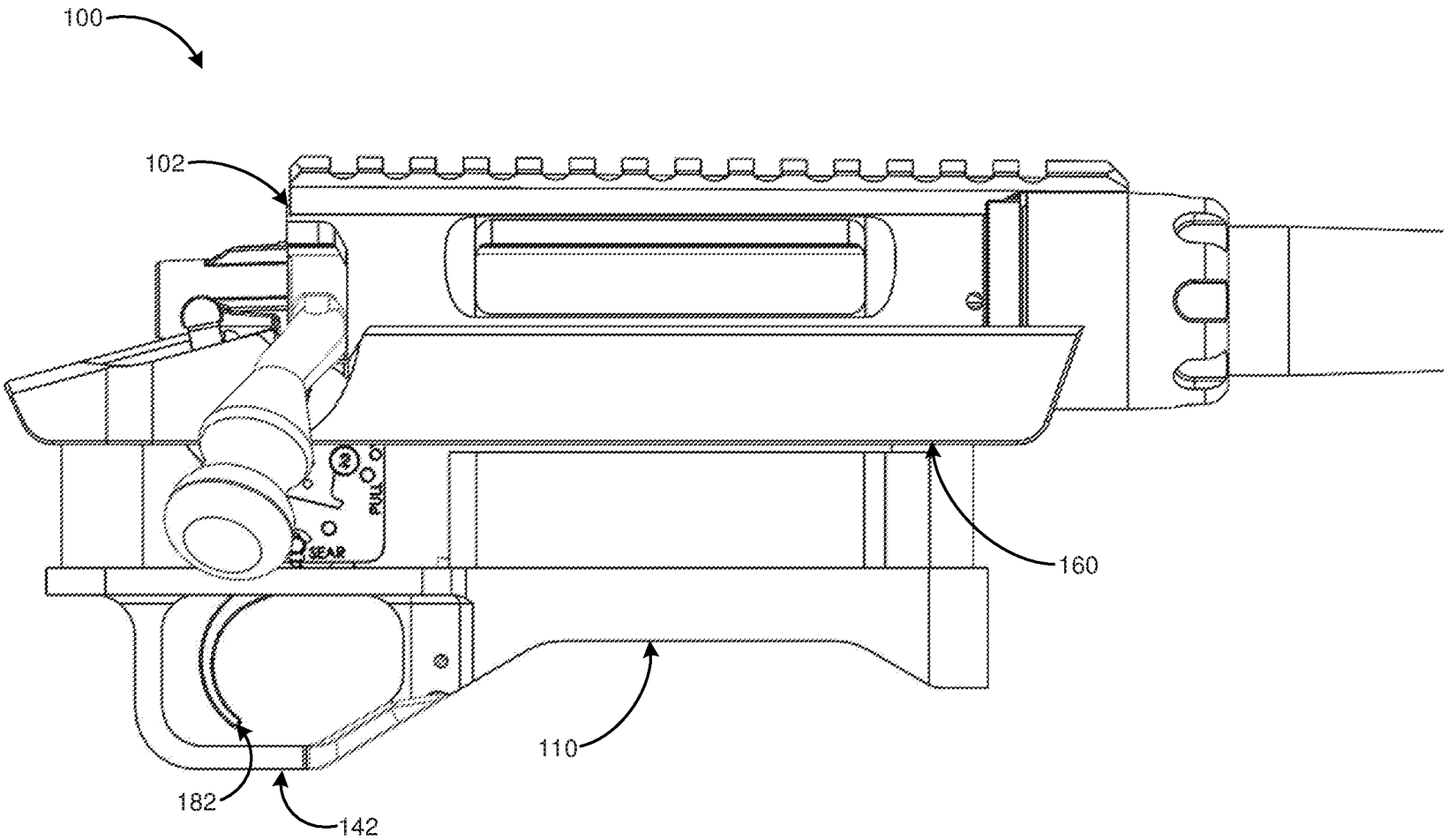
FIG. 1 is a perspective partial x-ray view of a firearm according to one or more embodiments of the disclosure.

The present disclosure is directed to a firearm receiver assembly with a bottom metal attached to a receiver with a fastener through a chassis on a bolt action firearm via two or more integrated pillars extending from the bottom metal. In this manner, the bottom metal may be a firearm component configured to have direct contact with the chassis while the chassis sits flush against the receiver. For example, the receiver may be set within a chassis with a complementary arcuate surface. The bottom metal may have two integrated pillars in communication with apertures of the receiver. Specifically, the bottom metal integrated pillars and the receiver may receive a fastener therethrough to secure the firearm receiver assembly together. One benefit of the bottom metal integrated pillars being in direct contact with the chassis and the receiver is the overall decrease in movement of the firearm receiver assembly. For example, after substantial use of the bolt action firearm, the forces associated with the firing may change the connection and spacing between the bolt action firearm's components (i.e., stock, bottom metal, chassis, and receiver) resulting in a decrease of the accuracy. Typically, a shooter zeroes the bolt action firearm's sights when first in use to ensure that it is accurate when in use. A change in the spacing of the components may alter the bolt action firearm from being zeroed resulting in a decrease of accuracy and reliability. For example, the engagement between the components may be susceptible to ambient environmental conditions (e.g., temperature, moisture, expansion and contraction, etc.) that change the connection and spacing of the components of the bolt action firearm's zero resulting in a decrease of accuracy and reliability.

In some embodiments, the firearm receiver assembly includes a receiver with apertures and a recoil lug. In some instances, the receiver may sit within the chassis. The chassis may be shaped to complement the receiver. That is, the chassis may include an arcuate shape on an aft end, top portion of the chassis where the firearm receiver partially sits within the chassis. The chassis may include a first slot, a second slot and a recoil lug slot. The first slot may be configured for a trigger attached to the receiver to pass through for user access. The second slot may be configured to align with a chamber port on the receiver. In some instances, a magazine holding cartridges may pass through the second slot to allow a cartridge to be later loaded through the chamber port on the receiver into the chamber of a barrel via the firearm's bolt. The recoil lug slot allows the recoil lug of the receiver to sit and be held in place to limit movement. The opposed bottom portion of the chassis may be configured to abut the bottom metal. The chassis may be secured between the bottom metal and the receiver. The bottom metal may include at least two pillars configured to align with pillar apertures on the receiver. The at least two pillars each may include a channel configured to receive a fastener therethrough. In this manner, the bottom metal, the chassis, and the receiver may be secured together. In some instances, each of the components (e.g., the bottom metal, the chassis, and the receiver) may be composed of metal. One benefit of each of the components being composed of metal as well as being fastened together is to decrease stock distortion that may cause a shift in the bolt action firearm's zero.

Figure 2:
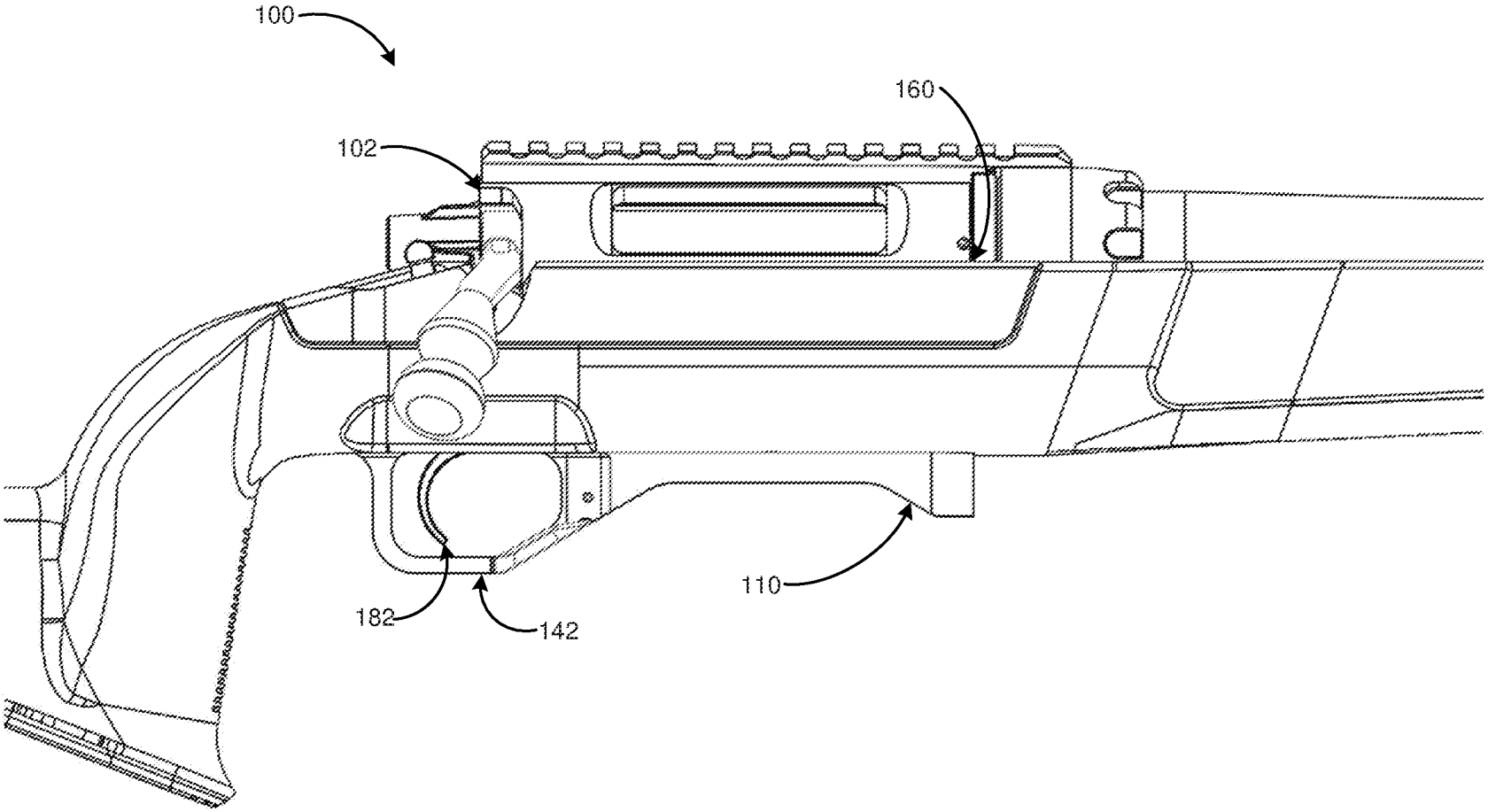
FIG. 2 is a second perspective partial x-ray view of the firearm according to one or more embodiments of the disclosure.

In some embodiments, as shown in FIGS. 1-2, a firearm receiver assembly 100 includes a firearm receiver 102, a chassis 160, and a bottom metal 110. For example, the receiver 102 may be at least partially set within the chassis 160. In some instances, the chassis 160 may have a complementary shape therein, such as an arcuate surface configured to complement the receiver 102. The chassis 160 may receive the bottom metal 110. The bottom metal 110 may extend toward the receiver 102 and be attached through the chassis 160. The trigger 182 may be connected to receiver 102 via a fastener. In some instances, the chassis 160 may contain a trigger 182. Each of the components, the receiver 102, the chassis 160, and the bottom metal 110, may be securely fastened together.

In some embodiments, as shown in FIGS. 3-8, the bottom metal 110 includes a base portion 112, a top side 114, an opposed bottom side 116, a distal end 118, and a proximate end 120. Any of the sides discussed herein may be interchanged with another side as well as the positioning of components along the bottom metal 110. In some instances, the base portion 112 may include one or more surfaces (e.g., the top side 114 and the opposed bottom side 116) from which each of the bottom metal 110 components extend (e.g., a side wall 156, the trigger guard 142, a first pillar 134 and a second pillar 132, etc.). In some instances, the bottom metal 110 may be composed of alloy steel such as chromium, molybdenum, vanadium, or nickel as alloying metals. In other instances, the bottom metal 110 may be composed of stainless steel, columbium, aluminum, or titanium. The bottom metal 110 may comprise any suitable metal.

Figure 3:
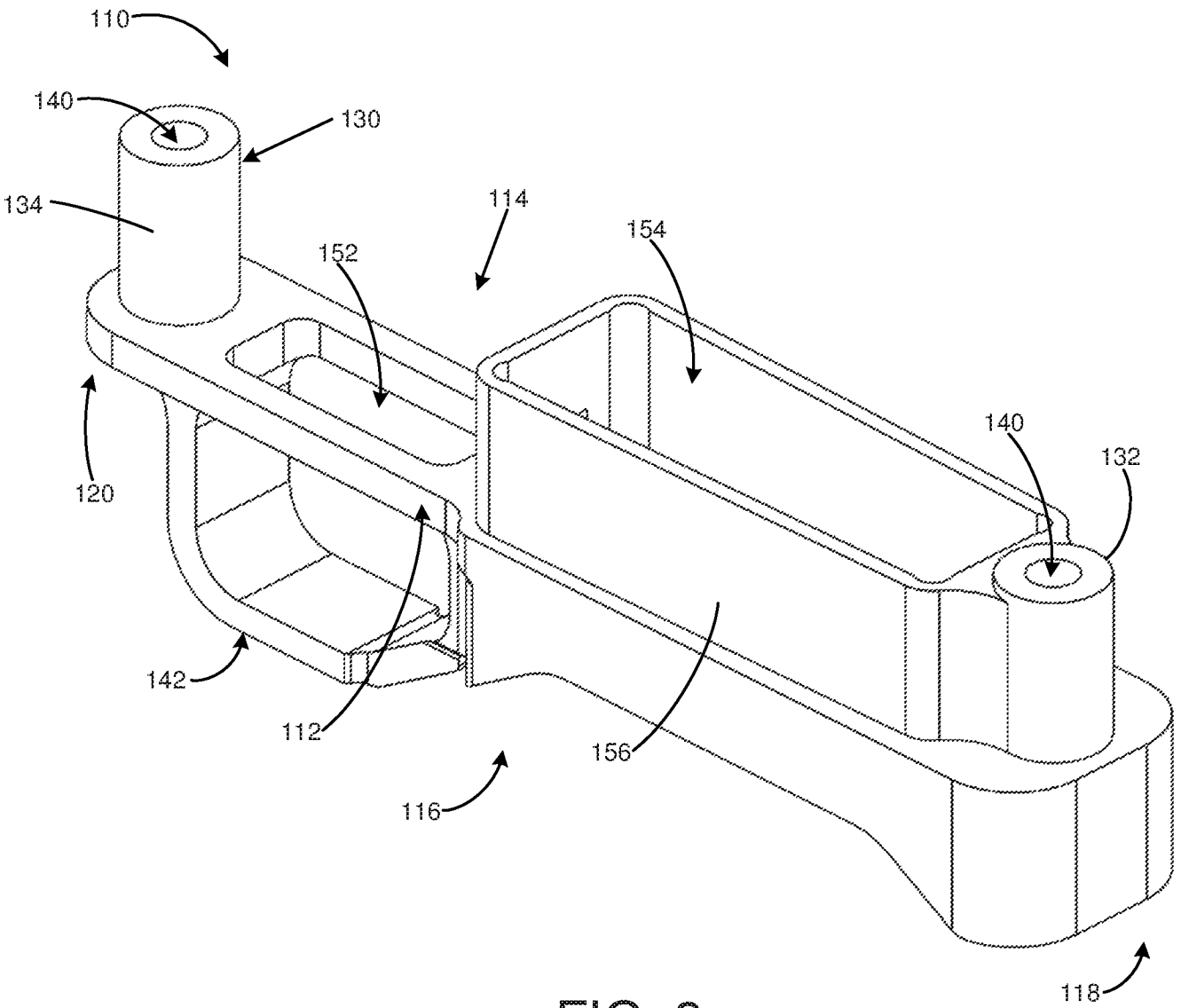
FIG. 3 is a perspective view of the bottom metal according to one or more embodiments of the disclosure.
Figure 4:
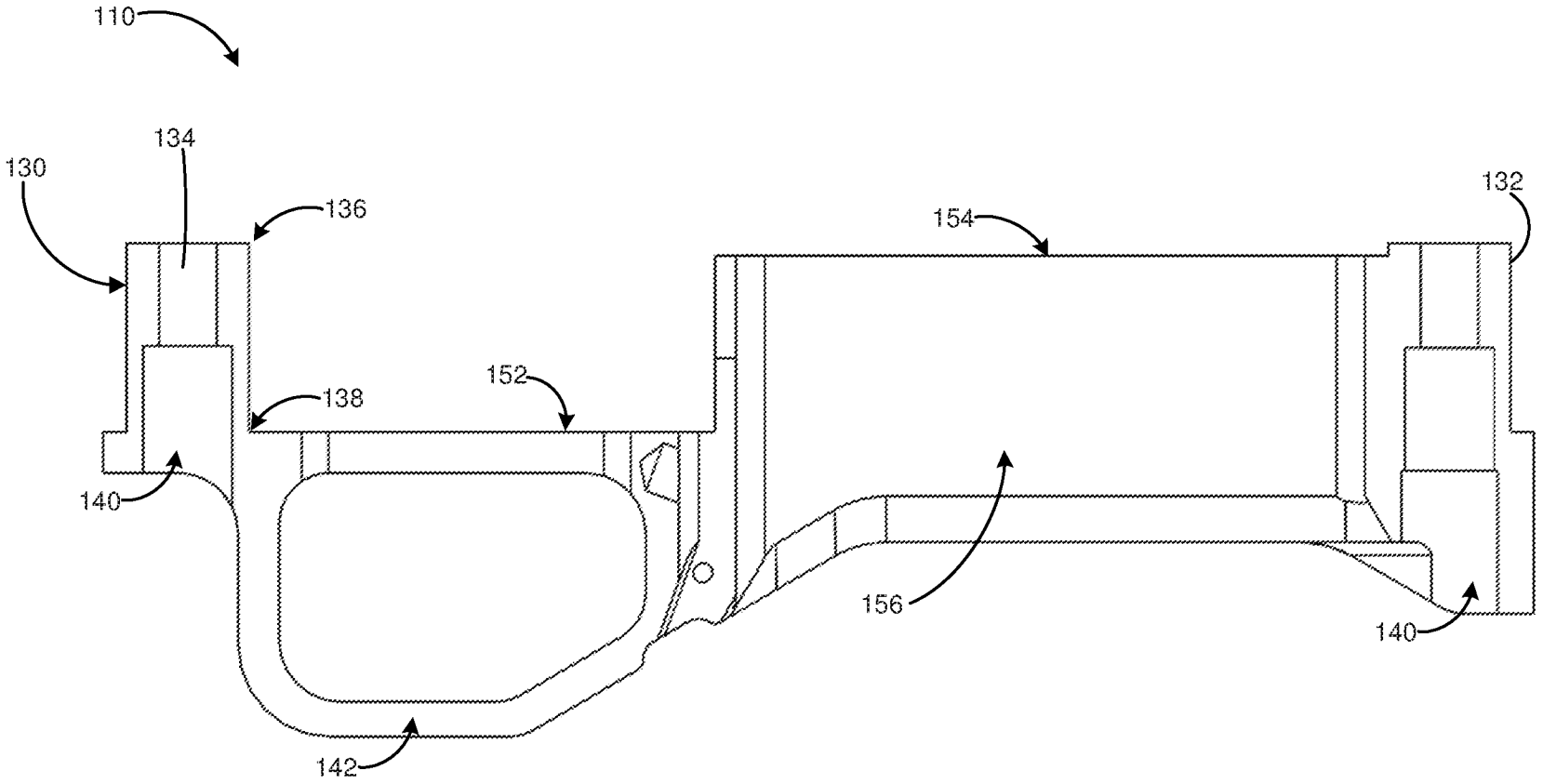
FIG. 4 is a side view of the bottom metal according to one or more embodiments of the disclosure.
Figure 6:
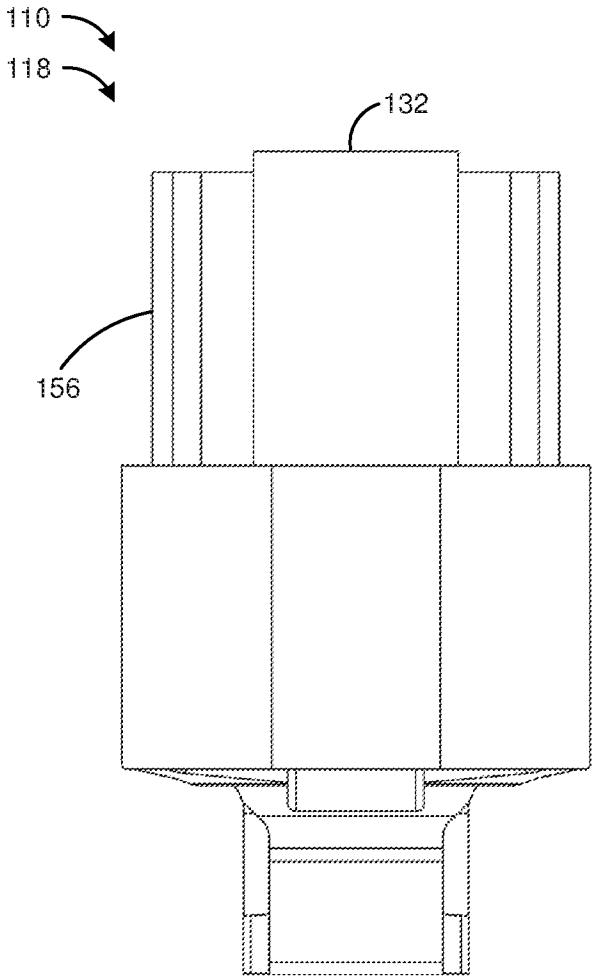
FIG. 6 is a distal end view of the bottom metal according to one or more embodiments of the disclosure.
Figure 5:
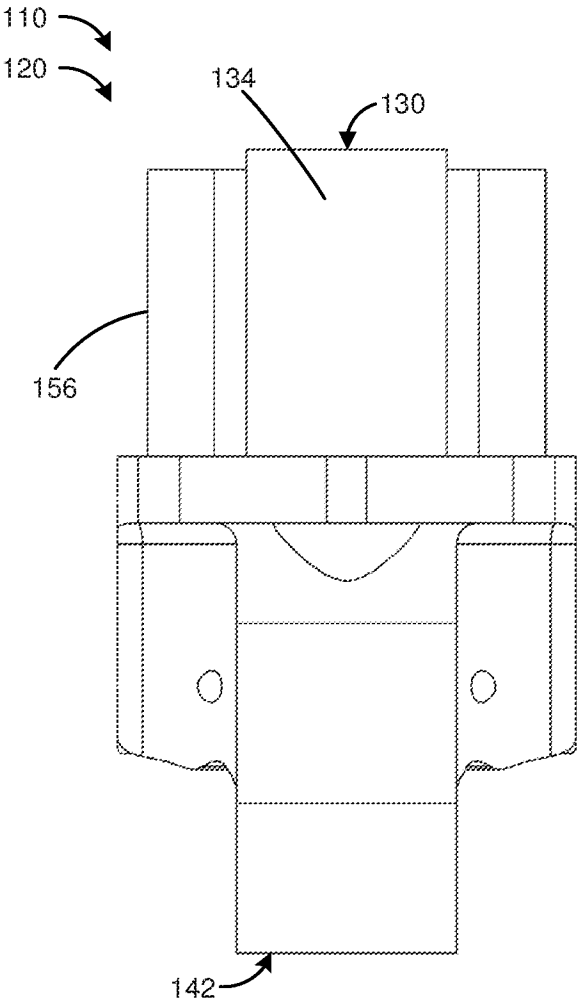
FIG. 5 is a proximate end view of the bottom metal according to one or more embodiments of the disclosure.
Figure 9:
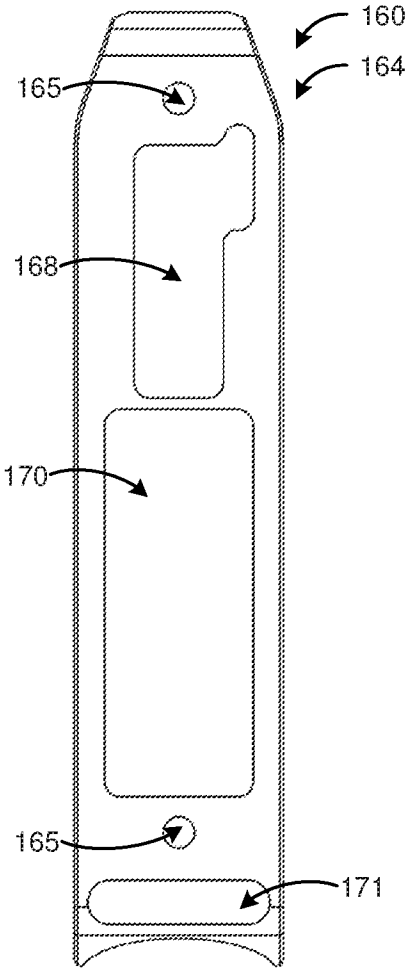
FIG. 9 is a bottom view of the chassis according to one or more embodiments of the disclosure.
Figure 8:
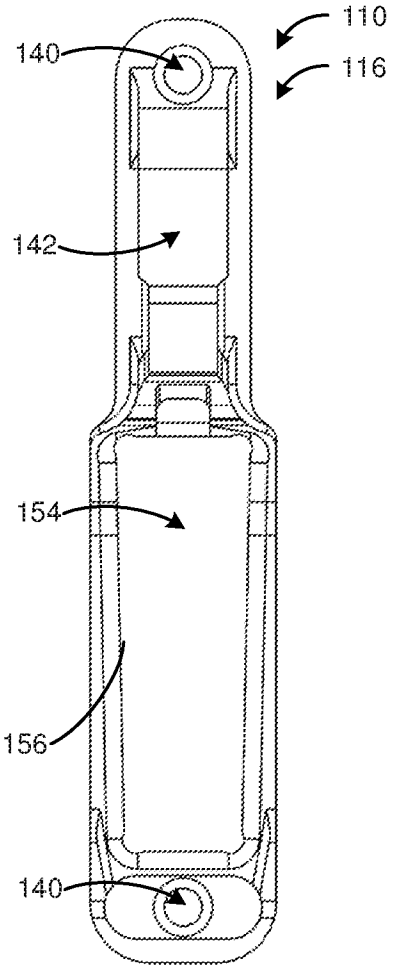
FIG. 8 is a bottom view of the bottom metal according to one or more embodiments of the disclosure.

In some embodiments, as shown in FIG. 3, the bottom metal 110 includes at least two pillars 130 (e.g., a first pillar, a second pillar) extending from the top side 114 of the base portion 112. In some instances, the at least two pillars 130 may be configured to align or be in communication with pillar apertures 104 (e.g., as shown on FIG. 15) on the receiver 102 (e.g., as shown in FIGS. 1 and 2). That is, the at least two pillars 130 may each include a channel 140 configured to receive a fastener (not shown). In this manner, the fastener may be pulled, pushed, and/or threaded through the channel 140 to the receiver 102. In some instances, the at least two pillars 130 may include a first end 136 configured to contact the chassis 160. In other instances, the first end 136 of the at least two pillars 130 may contact the receiver 102. The at least two pillars 130 may include a second end 138 extending from the base portion 112 of the bottom metal 110. The at least two pillars 130 may extend perpendicularly from a longitudinal axis of the base portion 112. In other instances, the at least two pillars 130 may extend at a different angle from the base portion 112. The channel 140 may extend from the first end 136 to the second end 138.

In some embodiments, as shown in FIG. 3, the bottom metal 110 includes a first pillar 134 and a second pillar 132. Each pillar may align with an aperture disposed on the receiver and/or the chassis. In some instances, the first pillar 134 may be disposed on the proximate end 120 of the bottom metal. Accordingly, the second pillar 132 may be disposed on the distal end 118. In other embodiments, the first pillar 134 and the second pillar 132 may be disposed anywhere along the base portion 112 of the bottom metal 110. In some instances, the at least two pillars 130 (e.g., the first pillar 134, the second pillar 132, or any number of other pillars disposed on the bottom metal 110) may be cylindrical. In other instances, the at least two pillars 130 may be another shape, such having a rectangular, square, or triangular cross-section.

Figure 7:
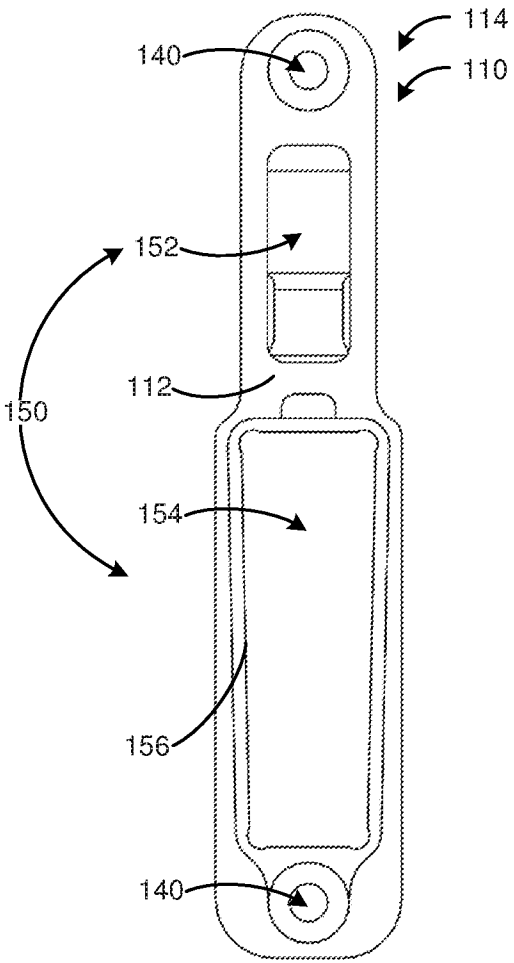
FIG. 7 is a top view of the bottom metal according to one or more embodiments of the disclosure.
Figure 11:
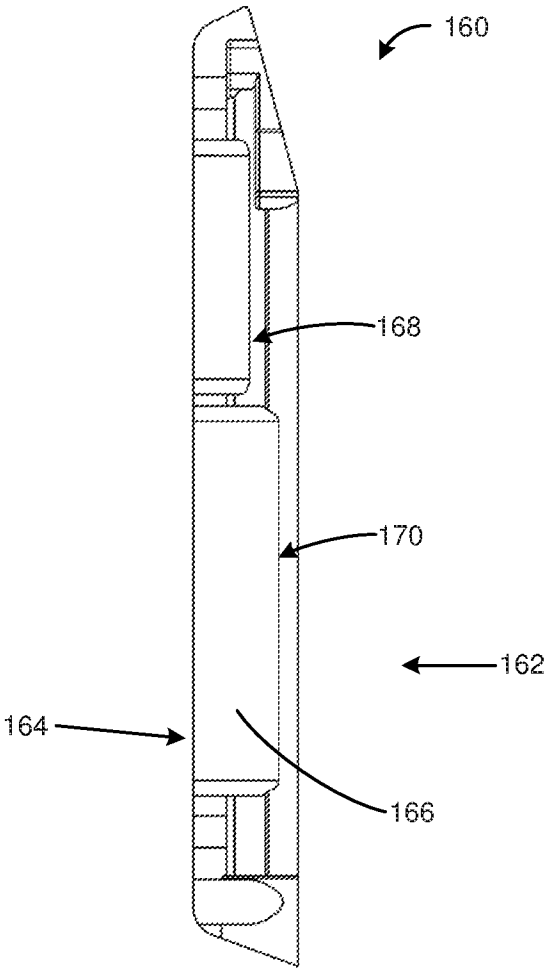
FIG. 11 is a side view of the chassis according to one or more embodiments of the disclosure.
Figure 10:
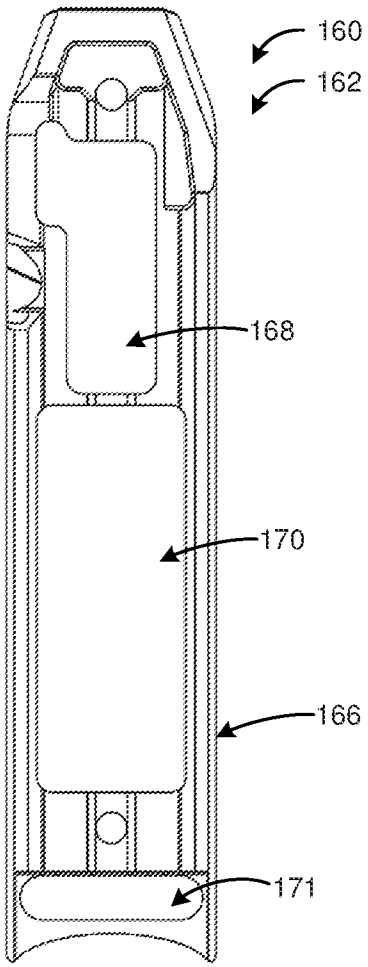
FIG. 10 is a top view of the chassis according to one or more embodiments of the disclosure.
Figure 12:
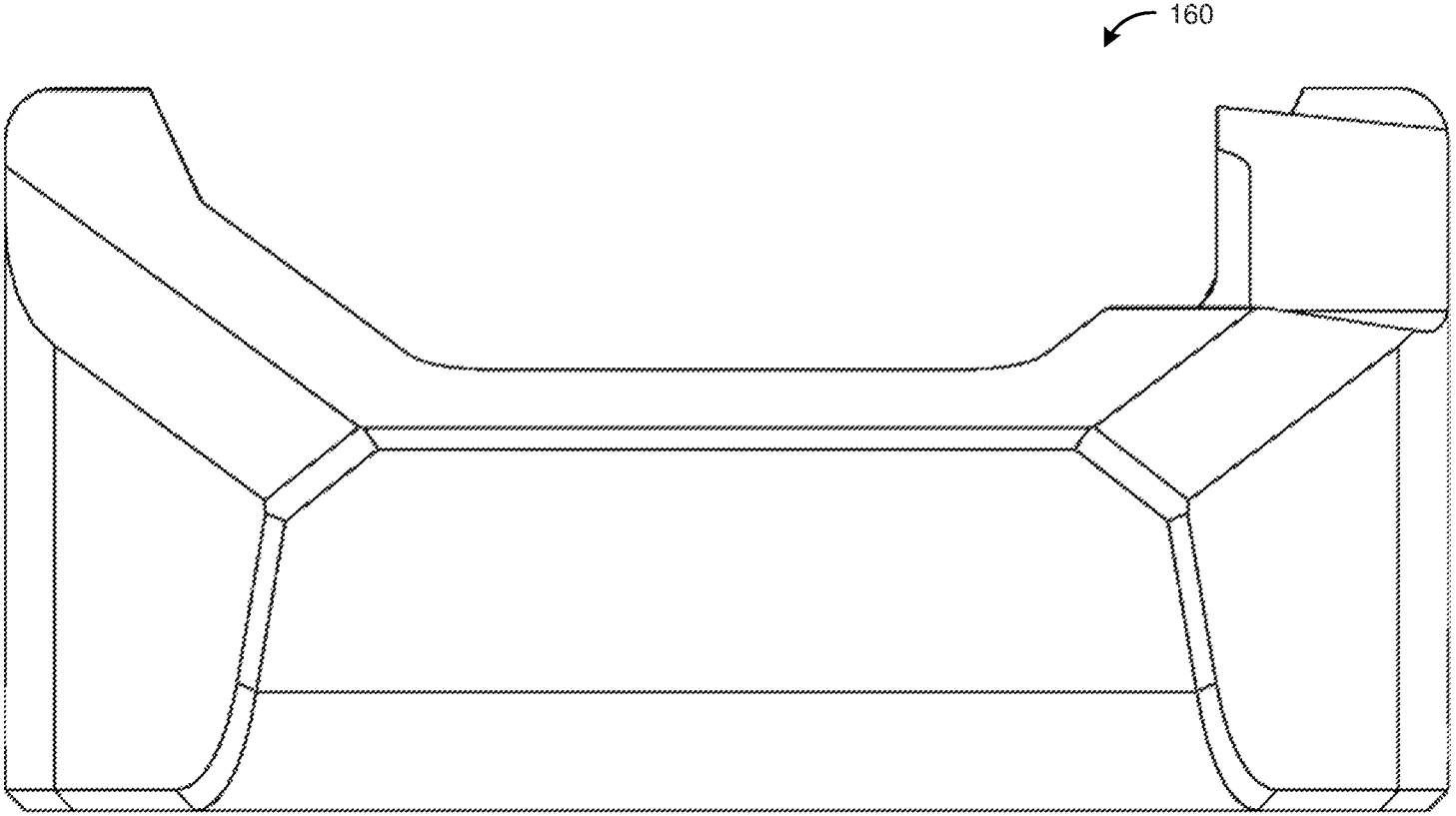
FIG. 12 is a rear view of the chassis according to one or more embodiments of the disclosure.
Figure 13:
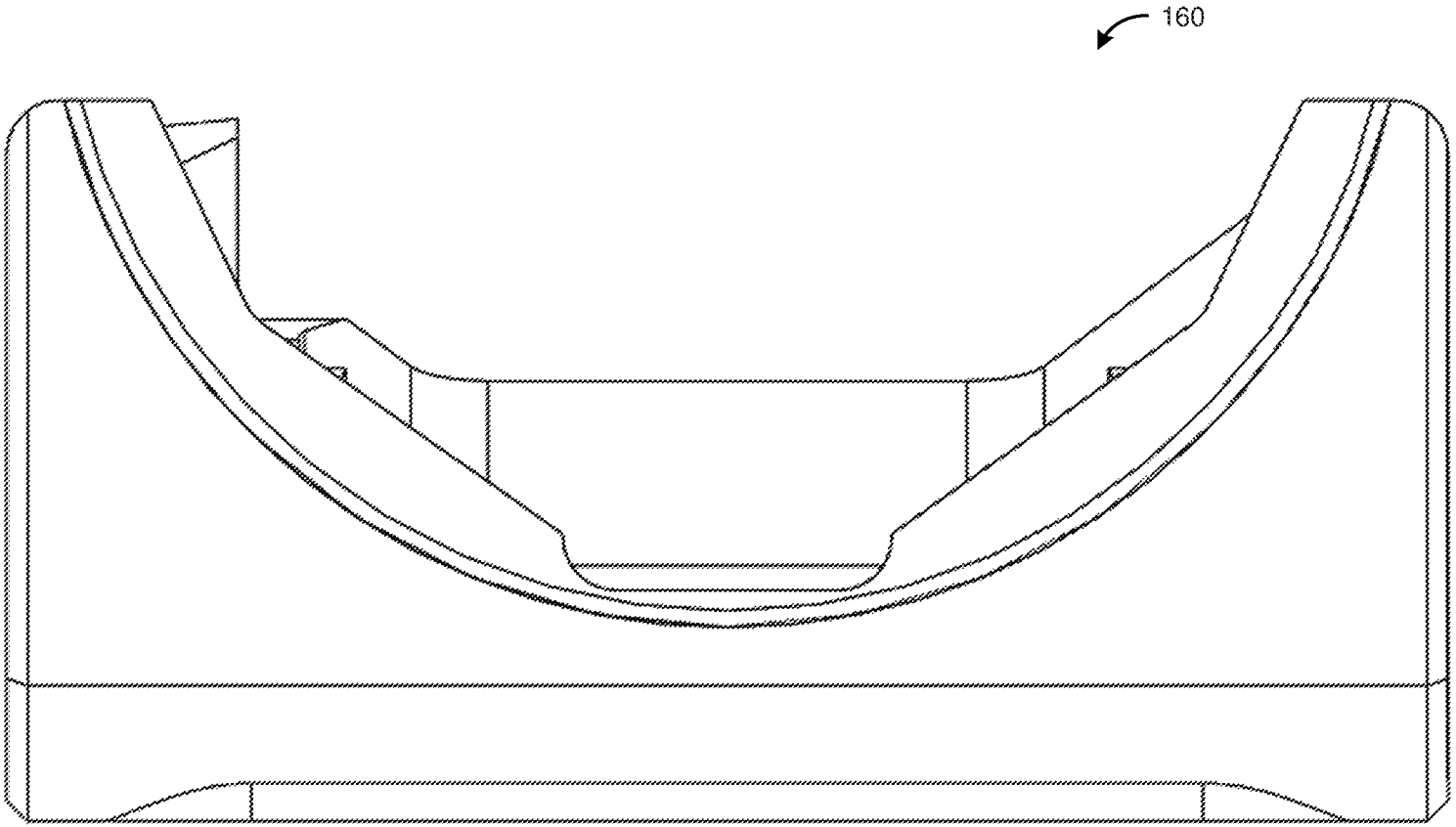
FIG. 13 is a front view of the chassis according to one or more embodiments of the disclosure.
Figure 15:
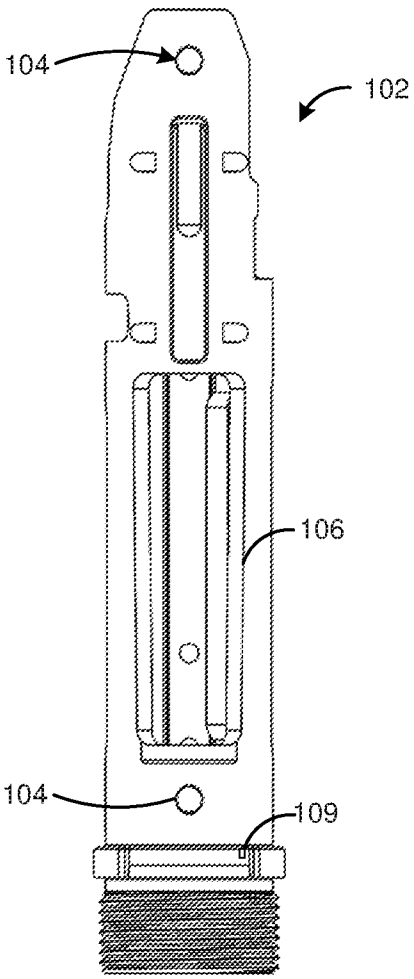
FIG. 15 is a bottom view of the receiver according to one or more embodiments of the disclosure.

In some embodiments, as shown in FIG. 7, the bottom metal 110 includes a plurality of slots 150. For example, the bottom metal 110 may include a trigger slot 152 configured to receive a trigger therethrough and a magazine slot 154 configured to receive a magazine and align with a chamber port 106 (e.g., as shown in FIG. 15). In some instances, the plurality of slots 150 may be rectangular. In other instances, the plurality of slots 150 may be another geometric shape, such as square, triangular, or circular. The magazine slot 154 may be configured to receive a firearm magazine. That is, the firearm magazine may slide within the magazine slot 154 up to the chamber port 106 to allow the receiver to receive cartridges for firing. In other instances, the firearm magazine may engage the magazine slot 154 by another method. In some instances, a side wall 156 (e.g., as shown in FIG. 3) may extend around the magazine slot 154 from the base portion 112 of the bottom metal 110. That is, the side wall 156 may extend the magazine slot 154 from the base portion 112 to the chamber port 106. In some instances, the at least one side wall 156 may include an aperture for a firearm magazine release lever or other mechanisms.

In some embodiments, the bottom metal 110 includes a trigger guard 142. That is, the trigger guard 142 may form a surface partially surrounding a trigger 182 (e.g., as shown in FIG. 1). In some instances, the trigger guard 142 may be substantially rectangular. In other instances, the trigger guard 142 may be another geometric shape, such as circular, square, or triangular.

In some embodiments, the firearm receiver assembly 100 includes a chassis 160. As shown in FIGS. 9-13, the chassis 160 may include a top portion 162, an opposed bottom portion 164, and a side portion 166. As mentioned earlier, the chassis 160 may be configured to receive the receiver 102. That is, the top portion 162 of the chassis 160 may be configured to receive the receiver 102. For example, the top portion 162 of the chassis 160 may include an arcuate surface to hold the receiver. Additionally, a recoil lug 109 of the receiver 102 may sit in the recoil lug slot 171 of the chassis 160 and thus securing the receiver 102 with the chassis 160. The bottom portion 164 of the chassis 160 may accommodate the bottom metal 110. Accordingly, as the receiver 102 rests within the complementary shape of the chassis 160 and the recoil lug 109 sits within the recoil lug slot 171, the bottom metal 110 may be secured with a fastener opposite the receiver 102 through the chassis 160. Moreover, the opposed bottom portion 164 may accommodate the bottom metal 110.

In some embodiments, the chassis 160 may include a first slot 168, a second slot 170 and the recoil lug slot 171. In some instances, the first slot 168 may align with the trigger slot 152 of the bottom metal 110. In this manner, the trigger of the bolt action firearm may extend through the first slot 168 and the trigger slot 152. Accordingly, the second slot 170 may align with the magazine slot 154 of the bottom metal 110. In this manner, the second slot 170 may receive the side wall 156 of the bottom metal 110 therethrough. The side wall 156 of the bottom metal 110 may slide through the second slot 170 of the chassis 160 to the chamber port 106 of the receiver 102. The first slot 168 and the second slot 170 may extend from the bottom portion 164 of the chassis 160 to the top portion 162. In some embodiments, the first slot 168 and the second slot 170 may be substantially rectangular. In other embodiments, the first slot 168 and the second slot 170 may be a number of other geometric shapes, such as circular, square, or triangular. In some instances, the chassis 160 may be composed of alloy steel such as chromium, molybdenum, vanadium, or nickel as alloying metals. In other instances, the chassis 160 may be composed of stainless steel, columbium, aluminum, or titanium.

Figure 14:
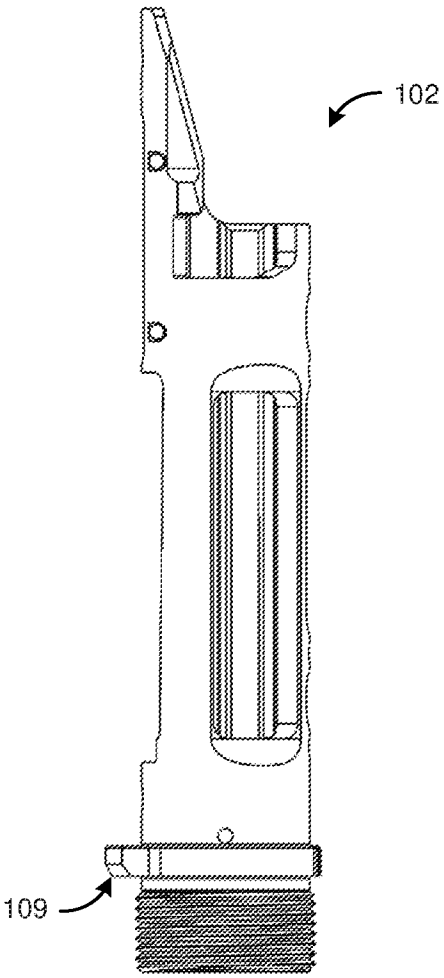
FIG. 14 is a side view of the receiver according to one or more embodiments of the disclosure.

In some embodiments, as shown in FIGS. 14-15, the firearm receiver assembly 100 includes the receiver 102. In some instances, the receiver 102 includes one or more pillar apertures 104 configured to receive a fastener. That is, the one or more pillar apertures 104 may align with the channel 140 of the integrated first pillar 134 and the integrated second pillar 132 of the bottom metal 110. As discussed herein, "integrated" may refer to a continuous, unitary, and/or single body. That is, the integrated pillars may be a continuous material and body with the bottom metal 110. The one or more pillar apertures 104 may align with apertures 165 in the chassis 160. The one or more pillar apertures 104 may be threaded for securing a fastener. A fastener may engage the bottom metal 110, the chassis 160, and the receiver 102 thereby securing and sandwiching the three components together. The receiver 102 may include the chamber port 106 configured to receive cartridges from a firearm magazine. Additionally, the receiver 102 may include the recoil lug 109 to sit within the chassis 160 and hold the receiver 102 in place. In some instances, the receiver 102 may be composed of alloy steel such as chromium, molybdenum, vanadium, or nickel as alloying metals. In other instances, the receiver 102 may be composed of stainless steel, aluminum, or titanium.

It is contemplated that the receiver 102 and the bottom metal 110 may rest within a stock eliminating the need for the chassis 160. It is further contemplated that the bottom metal 110 may have integrated pillars 134 and 132 that may pass directly through the stock to the receiver 102. Bottom metal 110 may be directly secured to the receiver 102 through the stock sandwiching all three components together via a fastener.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A firearm receiver assembly, comprising:
- a receiver comprising at least two pillar apertures;
- a chassis comprising a top portion, a bottom portion, and at least two pillar apertures; and
- a bottom metal comprising a top side, a bottom side, and at least two pillars extend from the top side, wherein the at least two pillars are integral with the bottom metal,
- wherein the chassis is sandwiched between the receiver and the bottom metal such that (i) the receiver is disposed about the top portion of the chassis, (ii) the bottom metal is disposed about the bottom portion of the chassis, and (iii) the at least two pillars of the bottom metal extend through the at least two pillar apertures of the chassis and the at least two pillar apertures of the receiver.

2. The firearm receiver assembly of claim 1, wherein the at least two pillars comprise:
- a first end;
- a second end integral with the bottom metal; and
- a channel extending between the bottom side of the bottom metal and the first end of the at least two pillars, wherein the channel is configured to receive a fastener therein in order to sandwich the receiver, the chassis, and the bottom metal together.

3. The firearm receiver assembly of claim 2, wherein the receiver comprises two pillar apertures each configured to align with the channel.

4. The firearm receiver assembly of claim 1, wherein the bottom metal comprises a trigger guard.

5. The firearm receiver assembly of claim 1, wherein the bottom metal is configured to receive a firearm magazine.

6. The firearm receiver assembly of claim 1, wherein the at least two pillars are cylindrical.

7. The firearm receiver assembly of claim 1, wherein the bottom metal comprises:
- a base portion;
- a trigger slot disposed on the base portion, wherein the trigger slot is configured to receive a trigger; and
- a receiver slot disposed adjacent to the trigger slot, wherein the receiver slot is configured to receive a firearm magazine.

8. The firearm receiver assembly of claim 7, wherein the bottom metal comprises a firearm magazine release lever.

9. The firearm receiver assembly of claim 7, wherein the chassis comprises:
- a trigger slot;
- a receiver slot; and
- a recoil lug slot, wherein the recoil slot is configured to receive a recoil lug of the receiver.

10. The firearm receiver assembly of claim 7, wherein the receiver slot of the bottom metal comprises at least one side wall extending from the base portion, wherein the at least one side wall is in communication with a receiver's chamber port.

* * * * *